United States Patent [19]

Herubel

[11] 4,097,964

[45] Jul. 4, 1978

[54] MACHINE FOR DRAWING TEXTILE FIBRES

[75] Inventor: Jean Frederic Herubel, Guebwiller, France

[73] Assignee: N. Schlumberger & Cie., Guebwiller, France

[21] Appl. No.: 715,212

[22] Filed: Aug. 17, 1976

[30] Foreign Application Priority Data

Sep. 12, 1975 [FR] France ..... 75 28002

[51] Int. Cl.[2] ..... D01H 5/00; D01H 5/74; D01H 5/86

[52] U.S. Cl. ..... 19/236; 19/258; 19/244; 19/293

[58] Field of Search ..... 19/267, 244, 252–255, 19/260, 293–295, 250, 261, 258, 236, 256; 308/DIG. 2, DIG. 10

[56] References Cited

U.S. PATENT DOCUMENTS

| | | | |
|---|---|---|---|
| 2,193,196 | 3/1940 | Jackson | 19/255 X |
| 2,686,939 | 8/1954 | Keyser | 19/250 |
| 3,129,468 | 4/1964 | Ambler | 19/293 X |

FOREIGN PATENT DOCUMENTS

| | | | |
|---|---|---|---|
| 559,619 | 8/1957 | Belgium | 19/293 |
| 492,536 | 9/1938 | United Kingdom | 19/258 |
| 851,989 | 10/1960 | United Kingdom | 19/252 |

*Primary Examiner*—Dorsey Newton
*Attorney, Agent, or Firm*—Toren, McGeady and Stanger

[57] ABSTRACT

A textile drawing machine has interchangeable drawing heads mounted between the feed rollers and the drawing rollers, to enable it to treat different types of textile fibres. The heads are readily replaceable in a frame of the machine and have support and drive members engaging support and drive members on the frame.

2 Claims, 5 Drawing Figures

MACHINE FOR DRAWING TEXTILE FIBRES

This invention relates to a machine for drawing textile fibres and having an upper and a lower fibre control system or drawing head.

In use, textile sliver, supplied by the feed rollers and which must be given a desired amount of draft, passes between the upper and the lower drawing heads and is then delivered by the drawing rollers into a can.

DESCRIPTION OF THE PRIOR ART

The drawing heads are constructed in accordance with the characterisation (e.g. length, quality, curliness) of the fibres to be treated. They can, for example, comprise aprons, cylinders, flexible control elements, or needles. A drawing machine may have one or more drawing sets, each comprising the mentioned drawing heads.

Known drawing machines of this type have a certain number of disadvantages. In view of the fact that the head construction is highly specific to the type of fibre to be processed, each machine can often treat only a single type of fibre, which severely limits its use. It is necessary to have a different machine for each type of fibre to be treated and, accordingly, high capital investment, out of all proportion to the actual use of the machines, is necessary.

This limitation of the known machines obviously reduces their overall efficiency.

The cost price of such a known machine is also relatively high, since the sliver-engaging parts of the heads, designed specifically for certain fibres cannot be mass-produced but most be produced in small batches or even individually.

The lack of universality of the machine makes its amortisation very slow.

OBJECT OF THE INVENTION

An object of the invention is to provide a machine for drawing textile fibres, which does not have the above mentioned disadvantages.

BRIEF STATEMENT OF THE INVENTION

The invention provides a machine, for drawing textile fibres, having a lower drawing head and an upper drawing head, said heads comprising support and drive members engaged with complementary support and drive members in a frame of the machine and being mounted on said frame so as to be readily detachable from said frame for replacement.

With the machine of the invention various different fibres can be treated simply by changing drawing heads.

The result of this is that the machine can function substantially without interruption and with optimum efficiency and satisfactory depreciation.

Investment is reduced since the machine is capable of replacing several specialised machines. Further, the manufacturer has to produce only a single type of frame and the various drawing heads can have common support and drive members.

BRIEF DESCRIPTION OF THE DRAWINGS

The invention will be described further, by way of example, with reference to the accompanying drawings, wherein.

DESCRIPTION OF A PREFERRED EMBODIMENT

Figure 1:
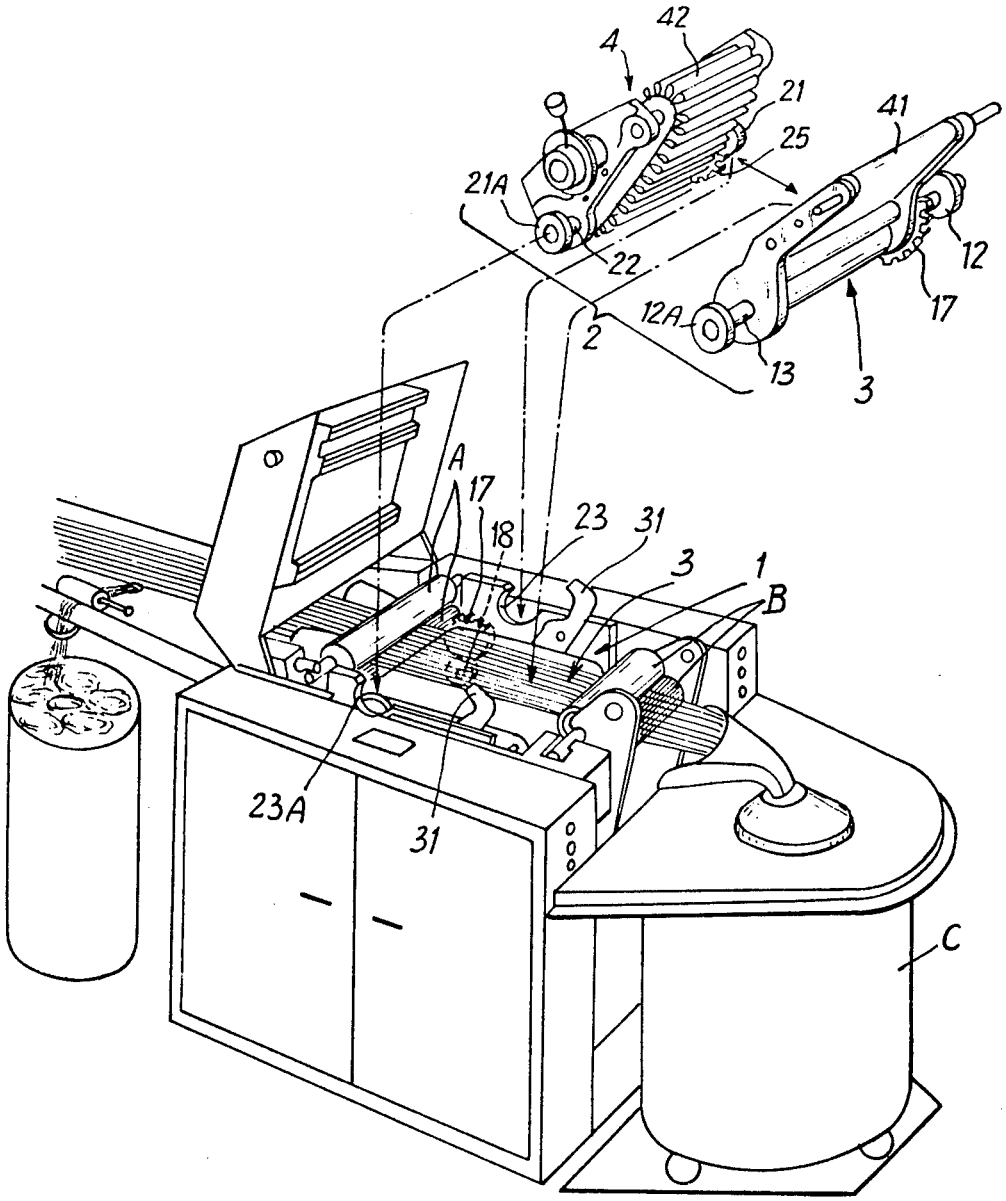
FIG. 1 is a perspective view of a preferred embodiment of machine of the invention, showing a lower drawing head in position in the machine and a pair of drawing heads above the machine.

A preferred embodiment of machine for drawing textile fibres, conforming to the invention, comprises a frame 1 in which can be mounted, between the pair of feed rollers A and the pair of drawing rollers B, different pairs of drawing heads, such as the pair 2 shown above the machine and comprising a lower head 3 and an upper head 4. In FIG. 1 the lower head 3 is shown in place in the frame of the machine, while the upper head 4 has been removed for clarity. C designates a delivery can.

Figure 2:
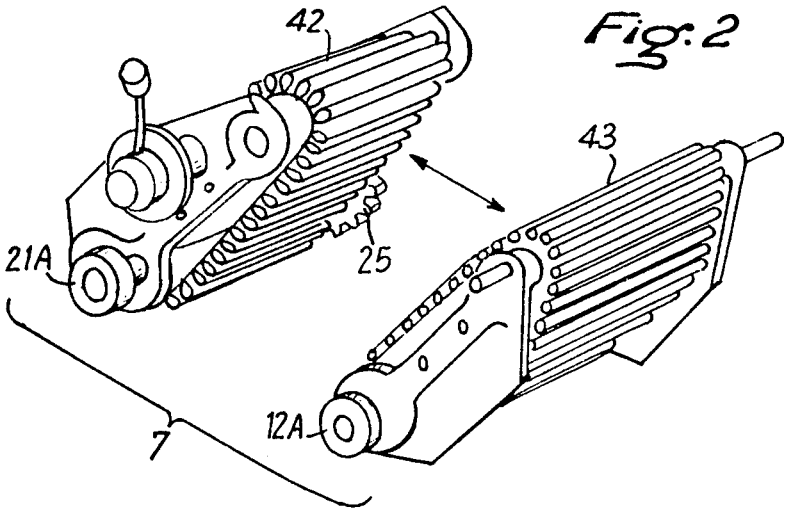
FIGS. 2 to 4 are perspective views of different pairs of drawing heads.
Figure 3:
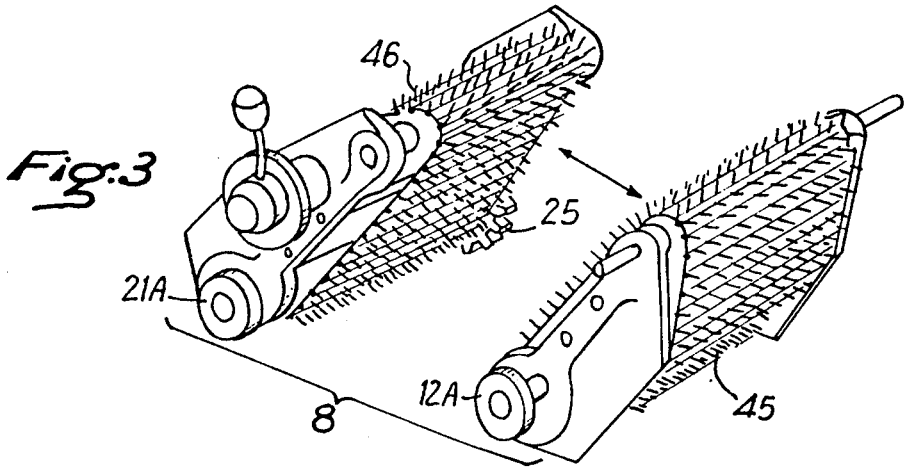
Figure 4:
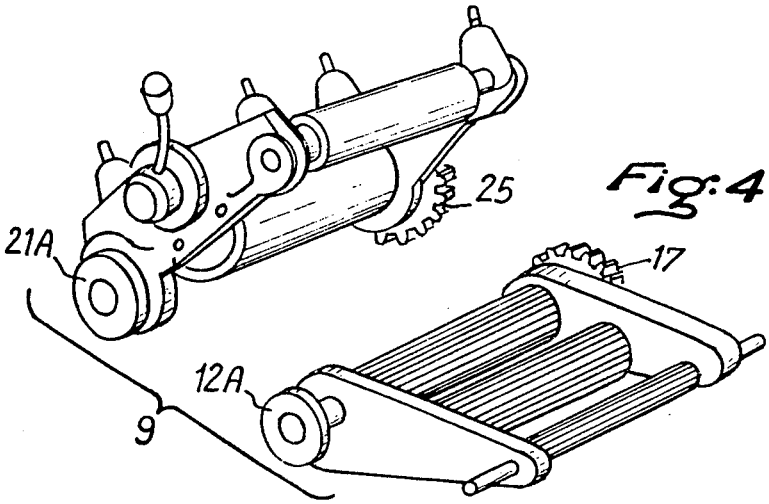

The frame of the machine and the pair of drawing heads 2 are designed and arranged so that the drawing heads are detachable and can be replaced by other heads having different structures, for example those shown at 7, 8 and 9 in FIG.2, 3 and 4.

Figure 5:
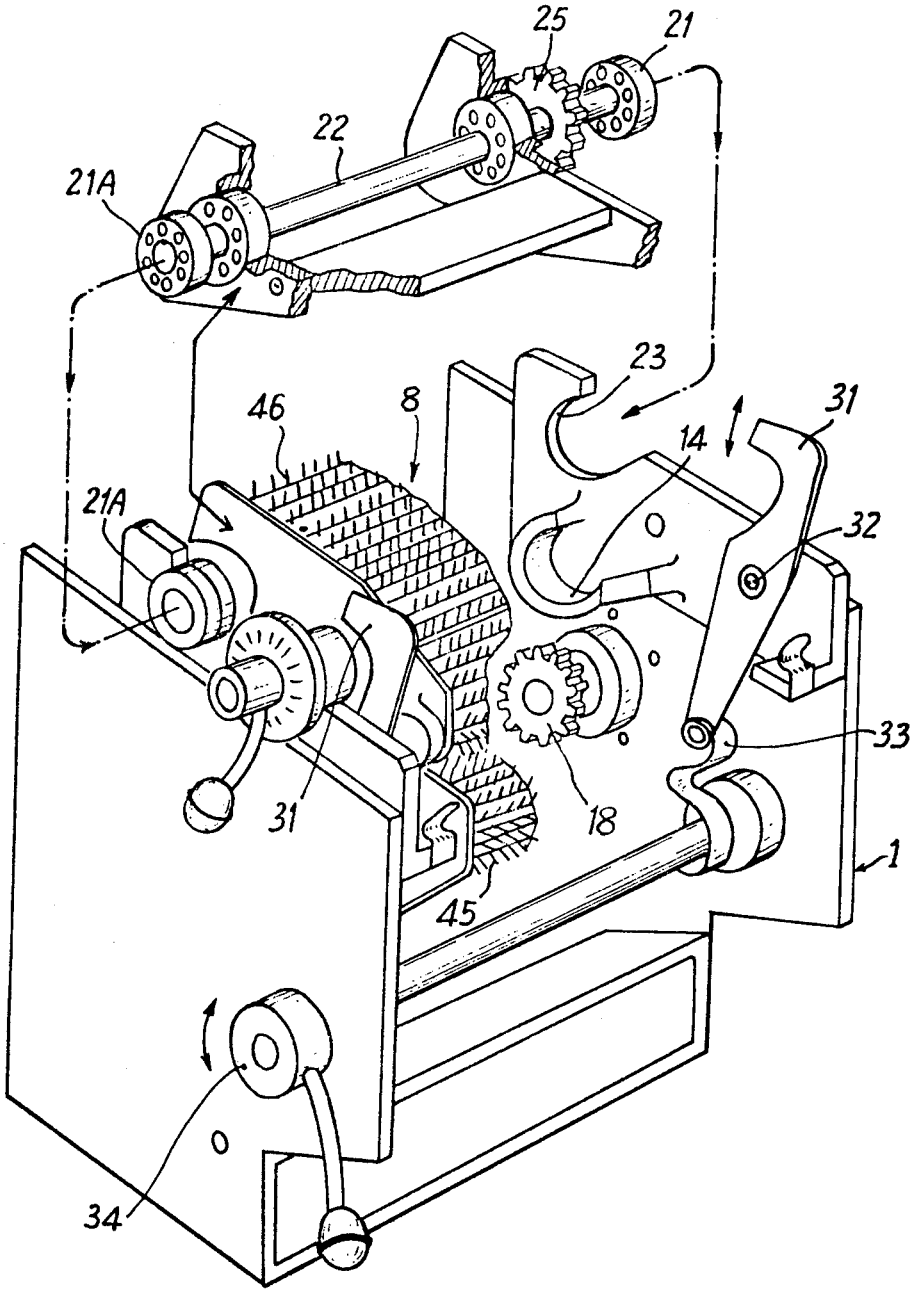
FIG. 5 is an enlarged fragmentary perspective view of part of the machine in FIG. 1 illustrating mountings for the drawing heads.

To this end, the different drawing heads are provided with support and drive members designed and arranged to cooperate with complementary support and drive members carried by the frame of the machine. Thus, on each side, the lower drawing head 3 (FIG.1) has a ball bearing 12, 12A, which is mounted on a shaft 13 of the head 3 and which can engage one of a pair of semi-cylindrical sockets 14 (visible in FIG. 5).

On the shaft 13 is also fixed a toothed driving wheel 17 which, when the head 3 is in place in the frame, meshes with a corresponding driving toothed wheel 18 (FIG. 5) of the machine.

In a similar manner, the upper drawing head 4 (FIG. 1) is provided with ball bearings 21, 21A which are carried by a shaft 22 and which can be accomodated in mountings 23, 23A, respectively, in the frame 1 of the machine. The shaft 22 of the upper drawing head carries a toothed wheel 25 which meshes with the toothed wheel 17 of the lower drawing head 3 when in place in the machine.

Means are provided to urge the upper head towards the lower head. To this end, there are provided hooks 31 which pivot on axes 32 of the frame 1 and which bear on shafts 22 of the upper drawing head, under the action of springs 33 controlled by an eccentric 34 having manual control.

Any pairs of heads can be mounted in the machine quickly and easily. If so desired, the lower head of one pair can be used with the upper head of another pair.

In the examples shown, the lower head of the pair of FIG. 1 has a smooth apron 41 and the upper head has flexible lips 42.

The pair of drawing heads 7 of FIG.2 comprises a lower head whose apron has ribs 43 and an upper head constituted by a caterpillar of soft fibre control elements or lips 42.

The pair of drawing heads 8 of FIG.3 comprises a lower head having an apron 45 and an upper head having an apron 46, both provided with a plurality of needles. This device is shown partially in FIG. 5.

Finally, the pair of drawing heads 9 of FIG. 4 comprises a lower head having a fluted cylinder and an upper head having rollers.

The invention is not limited to the precises details of the foregoing and variations can be made thereto within the scope of the following claims.

I claim:

1. A textile fiber drawing machine comprising a frame, feed rollers and drawing rollers rotatably mounted in spaced relation in said frame, a lower drawing head having fiber treating mobile elements of selected characteristics removably mounted in said frame for interchangeability with non-selected lower drawing heads having fiber treating mobile elements of differing characteristics, said lower drawing head being located between said feed rollers and said drawing rollers, said fiber treating mobile elements of said lower drawing head mounted in said frame having characteristics which are different from the characteristics of the fiber treating mobile elements of non-selected lower drawing heads, an upper drawing head having fiber treating mobile elements of a selected characteristic removably mounted in said frame for interchangeability with non-selected upper drawing heads having fiber treating mobile elements of differing characteristics, said upper drawing head being located between said feed rollers and said drawing rollers for cooperation with said lower drawing head, said fiber treating mobile elements of said upper drawing head mounted in said frame having characteristics which are different from the characteristics of the fiber treating mobile elements of non-selected upper drawing heads, said fiber treating mobile elements of said upper and lower drawing heads mounted in said machine positioned for cooperation with each other for drawing preselected fibers through said machine, two pair of substantially semi-cylindrical sockets carried by said frame for removably supporting said upper and lower drawing heads in said machine, said lower drawing head having a drive shaft and ball bearing support members carried thereon, said ball bearing support members of said lower drawing head being supported within one pair of said semi-cylindrical sockets, said upper drawing head having a drive shaft and ball bearing support members carried thereon, said ball bearing support members of said upper drawing head being supported within the other pair of said semi-cylindrical sockets, said drive shaft of said upper and lower drawing heads being operatively connected with said fiber treating mobile elements of said upper and lower drawing heads respectively, said ball bearing support members of said upper and lower drawing heads and said two pair of semi-cylindrical sockets for supporting said upper and lower drawing heads respectively being adapted for rapid positioning and removal of said upper and lower drawing heads respectively in said machine, said drive shaft and ball bearing support members of said lower drawing head being identical with a drive shaft and ball bearing support members of non-selected lower drawing heads to facilitate interchangeability of lower drawing heads, said drive shaft and ball bearing support members of said upper drawing head being identical with a drive shaft and ball bearing support members of non-selected upper drawing heads to facilitate interchangeability of upper drawing heads, drive means carried on said lower drawing head for causing rotation of said drive shaft for driving the fiber treating mobile elements of said lower drawing head, the drive means of said lower driving head being identical with drive means of non-selected lower driving heads for interchangeability, drive means carried by said upper drawing head for causing rotation of said drive shaft on said upper drawing head for driving said fiber treating mobile elements thereon, said drive means on said upper drawing head being identical to drive means on non-selected upper drawing heads to facilitate interchangeability, and a drive member carried by said frame for driving the drive means of said upper and lower drawing heads, the drive means on said lower drawing head being positioned in said frame for cooperative engagement with said drive member in said frame, the drive means on said upper drawing head positioned in said frame being in cooperative engagement with said drive means on said lower drawing head positioned in said frame.

2. The machine as defined in claim 1 wherein said drive means on said upper and lower drawing heads comprises a toothed wheel mounted on said drive shaft of said upper and lower drawing heads respectively, and wherein said drive member in said frame comprises a toothed wheel mounted for cooperation with said toothed wheel of said lower drawing head.

* * * * *